US007191959B2

(12) United States Patent
Kutay et al.

(10) Patent No.: US 7,191,959 B2
(45) Date of Patent: Mar. 20, 2007

(54) DOMESTIC SPRAY DEVICE

(75) Inventors: Susan Michelle Kutay, Wirral (GB); Guy Richard Thompson, Leeds (GB)

(73) Assignee: Unilever Home & Personal Care USA division of Conopco, Inc., Chicago, IL (US)

( * ) Notice: Subject to any disclaimer, the term of this patent is extended or adjusted under 35 U.S.C. 154(b) by 240 days.

(21) Appl. No.: 10/917,192

(22) Filed: Aug. 12, 2004

(65) Prior Publication Data

US 2005/0045745 A1 Mar. 3, 2005

(30) Foreign Application Priority Data

Aug. 13, 2003 (EP) ..... 03255021

(51) Int. Cl.

| | |
|---|---|
| ***A62C 13/62*** | (2006.01) |
| ***A62C 5/02*** | (2006.01) |
| ***A62C 31/00*** | (2006.01) |
| ***B05B 7/32*** | (2006.01) |
| ***B05B 7/30*** | (2006.01) |

(52) U.S. Cl. ..... 239/302; 239/8; 239/10; 239/303; 239/337; 239/351; 239/368; 239/398; 239/399; 239/406

(58) Field of Classification Search ..... 239/302, 239/8, 10, 303, 337, 311, 351, 366, 368, 369, 239/373, 398, 399, 406
See application file for complete search history.

(56) References Cited

U.S. PATENT DOCUMENTS

| | | | | |
|---|---|---|---|---|
| 3,682,390 | A * | 8/1972 | Cheshire et al. | 239/399 |
| 3,907,207 | A * | 9/1975 | O'Brien | 239/415 |
| 3,977,608 | A * | 8/1976 | Bullock | 239/410 |
| 4,222,525 | A * | 9/1980 | Hildebrandt | 239/343 |
| 4,396,152 | A | 8/1983 | Abplanalp | 239/337 |
| 4,473,185 | A | 9/1984 | Peterson et al. | 239/8 |
| 5,046,667 | A | 9/1991 | Fuhrig | 239/124 |
| 5,192,009 | A | 3/1993 | Hildebrandt et al. | 222/400.5 |
| 5,323,935 | A | 6/1994 | Gosselin et al. | 222/401 |
| 5,730,367 | A | 3/1998 | Pace et al. | 239/408 |

FOREIGN PATENT DOCUMENTS

| | | |
|---|---|---|
| EP | 1 314 481 | 5/2003 |
| EP | 1 325 782 | 7/2003 |
| FR | 1317768 | 5/1963 |
| GB | 971760 | 10/1964 |
| WO | 00/16026 | 3/2000 |

OTHER PUBLICATIONS

Co-pending application: Applicant: Kutay et al., U.S. Appl. No. 10/917,192; Filed: Aug. 12, 2004; Case No. J3726(C).

(Continued)

*Primary Examiner*—Davis Hwu
(74) *Attorney, Agent, or Firm*—Karen E. Klumas

(57) ABSTRACT

A domestic spray device comprising a liquid reservoir (1), a continuous feed gas pump (3) with a control means (5) for activation thereof, and a means of transferring liquid (2) from the liquid reservoir (1) to a nozzle unit (12), the nozzle unit (12) comprising a means of forming a film of liquid, a means of injecting bubbles of gas into said film of liquid, said gas being forced into the nozzle unit (12) by the continuous feed gas pump (3), and a section of hardware defining an exit orifice (19) for the spray generated.

19 Claims, 1 Drawing Sheet

OTHER PUBLICATIONS

European Search Report in an EP application EP 03 25 5021.
PCT International Search Report in a PCT application PCT/EP 2004/008504.
European Search Report in an EP application EP 03 25 5020.
PCT International Search Report in a PCT application PCT/EP 2004/008503.
Derwent Abstract of WO 2000/16026—published Aug. 31, 1999.
Derwent Abstract of EP 1 314 481—published Sep. 25, 2002.

* cited by examiner

DOMESTIC SPRAY DEVICE

FIELD OF INVENTION

The present invention is in the field of domestic spray devices; in particular, cosmetic spray devices. The invention relates to a hand-held domestic spray device that utilises a gas pump to enable spray generation via effervescent atomisation.

BACKGROUND

Currently marketed domestic spray devices predominately use a pressurised propellant to at least in part enable spray generation. A widely used option has been the use of VOCs, such as liquefied hydrocarbons or chlorofluorocarbons, to pressurise the liquid composition. However, it is increasingly recognised that the addition to the atmosphere of VOCs/greenhouse gases may have detrimental environmental consequences.

Other marketed domestic spray devices involve the use of hand-powered mechanical mechanisms, such as squeeze spray and trigger spray devices, to enable spray generation. Unfortunately, such mechanisms suffer the inherent problem of requiring physical effort on the part of the consumer. In addition, devices utilising this mechanism or simple variants thereof tend not to produce good quality sprays. Solutions to the problems encountered with the above spray devices have been suggested, certain of which involve the use of alternative atomisation techniques. Thus, numerous patents refer to the possible use of electrostatic atomisation, where spray generation is brought about by subjecting the liquid to be sprayed to a high electric potential. Certain other patents refer to the possibility of ultrasonic atomisation, which utilises high frequency vibrational energy to break up a liquid into discrete droplets.

A further 'alternative' atomisation technique is that of effervescent atomisation, where gas is bubbled into a film of liquid causing it to break up into discrete droplets. Most of the work in this area has related to fuel atomisation, particularly in the automobile industry [see, for example, U.S. Pat. No. 5,730,367 (Pace and Warner)]. However, U.S. Pat. No. 5,323,935 (Gosselin et al) appears to describe a domestic spray device that may operate by effervescent atomisation, at least in one of the embodiments of the invention. Use of this atomisation technique overcomes many of the problems of conventional domestic spray devices, as described above. The devices described by Gosselin et al create the required air flow by manually pressurising an air pressure chamber. In practice, this means that the air can only be used in discrete quantities before the air pressure has to be recharged. In addition, the air to liquid mass ratio that can achieved is limited by such discrete feed pumping means—U.S. Pat. No. 5,323,935 claims only between 0.01:1 and 0.06:1.

The present invention involves the use of a continuous feed gas pump, typically an electrically powered pump. The use of such pumps in spray devices is described in U.S. Pat. No. 5,192,009 (Hildebrandt et al) and U.S. Pat. No. 5,046,667 (Fuhrig); however, the spray devices described in these patents do not utilise effervescent atomisation. Hildebrandt discloses a known nozzle in which fluid (liquid) is introduced through tangential ducts and is broken up by air from an air inlet opening. Fuhrig discloses a nozzle in which air is supplied via a two component vortexing system and is fed orthogonally to the edge of a central liquid stream. Neither of these publications suggests the benefits attained by the use of a continuous feed gas pump with an effervescent atomisation spray device.

SUMMARY OF THE INVENTION

We have found that domestic spray devices that operate by effervescent atomisation advantageously comprise a continuous feed gas pump. Such spray devices not only have the aforementioned benefits derivable from effervescent atomisation, but also have the benefit of not being restricted with regard to the amount of gas that can be injected into the liquid film in the nozzle unit. This can lead to enhanced spray duration and the option of having moderately high gas:liquid ratios which we have found to lead to the production of high quality sprays.

Thus, in a first aspect of the invention, there is provided a domestic spray device comprising a liquid reservoir, a continuous feed gas pump with a control means for activation thereof, and a means of transferring liquid from the liquid reservoir to a nozzle unit, the nozzle unit comprising a means of forming a film of liquid, a means of injecting bubbles of gas into said film of liquid, said gas being forced into the nozzle unit by the continuous feed gas pump, and a section of hardware defining an exit orifice for the spray generated.

In a second aspect of the invention, there is provided a method of spraying a liquid composition comprising the use of a device as described in the first aspect of the invention.

In a third aspect of the invention, there is provided a product comprising a device as described in the first aspect of the invention and a liquid composition for spraying therefrom.

DETAILED DESCRIPTION

Figure 1:
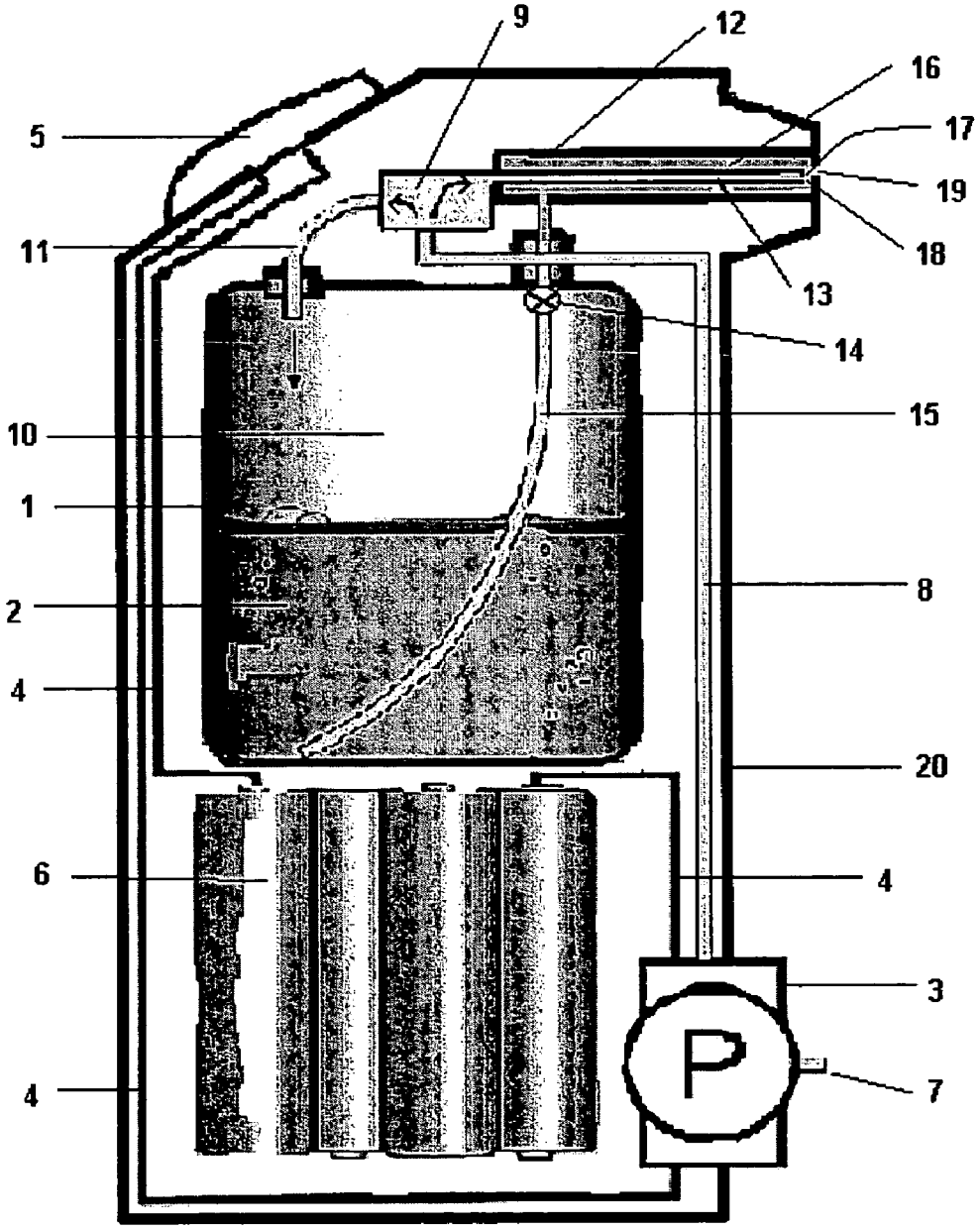
FIG. 1 is a cross-sectional representation of a specific embodiment of the present invention.

The continuous feed gas pump used in the present invention is one that is capable of delivering a continuous, i.e. uninterrupted, flow of gas. In this respect, it contrasts with manually operated trigger spray pumps and the like, which can only deliver discrete quantities of gas and which require that spray generation be interrupted whilst the trigger or equivalent means returns to its starting position. The continuous feed gas pump used in the present invention is activated by a control means (vide infra) and is capable of continuous operation until it is deactivated. In use, the continuous feed gas pump typically operates for a period of three, four, or more seconds; the pump being capable of continuous operation for such periods of time.

The continuous feed gas pump is preferably of a form capable of forcing gas directly into the nozzle unit upon activation. Use of the continuous feed gas pump in this manner, in contrast to use of a pump as a gas compressor, is a preferred method of spraying according to the invention. Preferably, the continuous feed gas pump is electrically driven.

The continuous feed gas pump may operate by positive displacement, the different principles including piston, gear, lobe, mohno, diaphragm, centrifugal, wobble plate and hose. Pumps that have valving means are preferred, in particular peristaltic pumps and scroll pumps. Scroll pumps, with their continuously compressing, self-valving operation are especially preferred.

The continuous feed gas pump used in the present invention may be able to achieve high gas flow rates, typically from 30 L/hr. to 500 L/hr., and, in particular, from 45 L/hr. to 180 L/hr. It is preferred that the pump is capable of generating a gas pressure of 5 psig. (1.38 bar) or greater. Typically, the pump generates from 5 to 50 psig. (1.38 to 4.46 bar), in particular from 10 to 30 psig. (1.70 to 3.77 bar) and especially from 10 to 20 psig. (1.70 to 2.39 bar). Surprisingly, good spray atomisation can be achieved at these pressures using devices according to the invention.

The control means for activating the continuous feed gas pump may be of any appropriate form. Typical examples include push buttons, toggle switches, or slide-operated switches. The activation typically involves supply of electrical power to the pump. The control means for activating the continuous feed gas pump may also be used to deactivate it, typically by releasing a push button or reversing a toggle or slide-operated switch. Alternatively, deactivation may be brought about by means of automatic shutdown after a set time, typically in the range of two to five seconds.

When the continuous feed gas pump is electrically driven, the source of the electrical power is preferably comprised within the device itself, although an external power supply may be used. The device may comprise a capacitor, battery (rechargeable, such as NiMH or NiCd or non-rechargeable, such as alkaline), or photovoltaic cell as a source of electrical power.

In general, a feed pipe takes gas from the continuous feed gas pump towards the nozzle unit. When present, the feed pipe may comprise one or more valves. Elevated pressure on the pump side of the valve may cause the opening of such valves; alternatively, such valves may be electronically controlled.

The nozzle unit comprises a means of forming a film of liquid and a means of injecting bubbles of gas into said film of liquid. A film of liquid may be understood as being planar in nature, both of the two orthogonal dimensions of the plane of the film being greater than the depth of the film, in particular being at least twice the depth of the film. Typically, the gas is introduced into the liquid film from a direction orthogonal to the plane of the film.

The film of liquid may be contained between the walls of a mixing chamber into which bubbles of gas are introduced through one or more gas injection ports. The dimensions of the mixing chamber may be such as to enable the formation of a film of liquid that is planar in nature, both of the two orthogonal dimensions of the plane of the film being greater than the depth of the film, in particular being at least twice the depth of the film.

In certain preferred embodiments the nozzle unit comprises a gas-liquid mixing chamber fed by gas from an inner tubular passage and liquid from an annular passageway surrounding the inner tubular passage. In such embodiments, the mixing chamber causes the liquid to form a film, into which gas is injected, through one or more gas injection ports, from the inner tubular passage. Frequently the mixing chamber is contiguous with the annular passageway for the liquid which feeds into it.

The nozzle unit further comprises an exit orifice for the spray initiated by the mixing of the gas and the liquid. It is preferred that the exit orifice is off-set from the inlet feed into the mixing chamber from the inner tubular passage. When there is more than one inlet feed into the mixing chamber from the inner tubular passage, it is preferred that the exit orifice is off-set from all of these. The term "off-set" should be understood to mean that the exit orifice is not in line with a given injection port, having regard to the direction of fluid entry into the mixing chamber.

The spray device may also comprise a means of further increasing droplet break-up; for example, a swirl chamber may be present, either as part of the nozzle unit, or continuous therewith. The swirl chamber, when present, increases droplet break-up by causing turbulent flow within the liquid-gas mixture entering the same.

The method of spraying according to the invention preferably involves the use of gas and liquid flow rates that, upon mixing of the gas and liquid, give a gas to liquid mass ratio (GLMR) of greater than 0.06:1, in particular greater than 0.1:1 and especially greater than 0.2:1. Such GLMRs may lead to good quality spray generation and preferred devices according to the invention are designed to achieve such GLMRs. The method of spraying according to the invention preferably involves the use of gas and liquid flow rates that, upon mixing of the gas and liquid, give a GLMR of less than 1:1, particularly less than 0.8:1, and especially less than 0.5:1, for the reasons of spray quality and efficiency; preferred devices according to the invention are designed to achieve such GLMRs.

For the purposes of this invention, spray quality may be defined by the fineness of the droplets achieved and/or by the narrowness of the droplet size distribution. It is desirable to achieve a Sauter mean droplet size (D[3,2]) of from 1:m to 100:m, in particular from 5:m to 60 :m, and especially from 5:m to 40:m. The narrowness of the droplet size distribution may be expressed by the "span", where span is [D(90)−D(10)]/D(50). The present invention preferably operates to give a SPAN of 3 or less, in particular 2.5 or less. The droplet size distribution is measured 15 cm from the exit orifice, typically using a light scattering technique with an instrument such as a Malvern Mastersizer.

The liquid reservoir holds the liquid to be dispensed. It may be replaced or re-filled when empty, although more commonly it holds sufficient liquid to give the device an economically acceptable working life without such action being necessary. The capacity of the reservoir is typically from 1 ml to 500 ml, in particular from 5 ml to 100 ml, and especially from 20 ml to 40 ml. It is generally made from a material impervious to the liquid to be dispensed, typical materials being plastics, such as polyolefins like polypropylene or polyethylene or addition copolymers, such as nylon or PET/POET. In a preferred embodiment, the liquid reservoir is made from a collapsible material, thereby avoiding any problems caused by the vacuum that might otherwise be created by the depletion of its contents during use. This sachet approach may also enable the operation of the device in any orientation.

The means of transferring liquid from the liquid reservoir to the nozzle unit may comprise a transfer conduit. When present, the transfer conduit preferably comprises one or more valves. Such valves may function to prevent leakage of the liquid composition from the reservoir when the pump is not operating. Elevated pressure on the reservoir side of the valve or reduced pressure on the nozzle side of the valve may cause the opening of such valves; alternatively, such valves may be electronically controlled.

The means of transferring the liquid from the liquid reservoir to the nozzle unit may comprise a pump that acts directly upon the liquid to be dispensed. Alternatively, a pump may be used as a gas compressor to create an elevated pressure above the liquid in the reservoir, a dip-tube optionally being used to allow the pressurised liquid to move towards the nozzle unit. In such embodiments, it is preferred that a headspace of gas be left above the liquid in the reservoir, in order for the compressor pump to have a certain gas volume to "compress". In a preferred embodiment, a single continuous feed gas pump serves both to force gas into the nozzle unit and as a gas compressor creating an elevated pressure upon the liquid in the reservoir.

In particularly preferred embodiments, gas is fed into the nozzle unit in advance of the liquid. This offers the advantage of giving the consumer a perception of dryness on using the spray device. In the same or other embodiments, the gas is fed through the nozzle unit subsequent to the flow of the liquid stopping. This offers the advantage of clearing liquid from the nozzle; in particular, the gas injection ports, mixing chamber, and the exit orifice; thereby minimising the blockage problems that can occur with some liquids (vide infra). Control of the timing of the gas and liquid flow may be achieved by use of valves, for example electronically controlled valves or mechanical flow control valves.

The spray device generally comprises an outer housing, supporting the control means for activating the pump and enclosing the other components. The spray device is typically of a size that can be held in one hand. It is preferred that the device can be both held and activated using only one hand.

Any appropriate gas may be used with spray devices of the present invention. Nitrogen, carbon dioxide, or air may be used. Air is most typically used.

The spray device of the present invention may be used with numerous liquids, including liquid compositions. They are particularly suitable for the application of liquid cosmetic compositions, which are typically applied directly to the human body. Examples of such liquid cosmetic compositions include hair sprays, perfume sprays, deodorant body sprays and underarm products, in particular antiperspirant compositions. Nozzles of the present invention are particularly suitable for applying liquid cosmetic compositions to the human body because of the excellent sensory properties that result; of particular note, are the good sensory properties obtained when the spray device is used in close proximity to the human body, thereby maximising deposition of the spray onto the body.

Some liquid compositions suitable for use with the spray device of the present invention may comprise dissolved or suspended solids; the avoidance of blockage problems can be particularly important with such compositions (vide supra).

Suitable liquid compositions frequently comprises a liquid carrier fluid, for example water and/or a C2 to C4 alcohol such as ethanol. When such liquid compositions are cosmetic compositions for application to the human body, the good spray quality attained leads to an excellent sensory benefit for the user. Suitable liquid compositions typically comprise water and/or C2 to C4 alcohol at a level of from 5% to 95%, in particular from 25% to 95%, and especially from 40% to 95% by weight of the composition. Liquid compositions comprising water and/or ethanol are particularly suitable for use with the device of the present invention.

Liquified propellant, in particular polar propellants, such as dimethyl ether (DME) or a hydrofluorocarbon, may be used as part of a composition sprayed in accordance with the present invention. However, liquified propellant is preferably present at level of 50% or less, more preferably 40% or less and most preferably 0.1% or less by weight of the total composition.

It should be understood that the method of spraying a liquid composition referred to as the second aspect of the invention may benefit from any of the optional features of the device described herein. Likewise, the product described as the third aspect of the invention may benefit from any of the optional features of the device and/or optional features of the liquid composition described herein.

The subject of the invention will now be further described by means of the specific embodiment illustrated schematically in FIG. 1.

With reference to FIG. 1, the illustrated specific embodiment comprises a liquid reservoir (1) holding a liquid composition (2). A continuous feed air pump (3) is connected by electrical circuitry (4) to a switch (5), which acts as a control means for activation thereof, and a battery pack (6), for providing power thereto. When activated, the continuous feed air pump (3) draws in air through an entry port (7) and forces it through a feed pipe (8) towards a vessel (9). From the vessel (9), a portion of the air passes into the headspace (10) above the liquid composition (2) in the liquid reservoir (1), via a further feed pipe (11). From the vessel (9), a portion of air also passes directly into a nozzle unit (12), entering an inner tubular passage (13).

The air entering the headspace (10) creates a positive pressure on the liquid composition (2) in the reservoir (1). When a critical pressure is attained, the liquid composition (2) is forced through a valve (14) in a transfer conduit (15) and into an annular passageway (16) surrounding the inner tubular passage (13) in the nozzle unit (12). The liquid in the annular passageway flows into a mixing chamber (17), where air is injected into it through an air injection port (18), thereby initiating spray formation. The spray produced leaves the device through an exit orifice (19), the exit orifice (19) being vertically off-set from the air injection port (18).

An outer housing (20) supports the switch (5) and encloses the other components of the device.

The invention claimed is:

1. A domestic spray device comprising a liquid reservoir (1), a continuous feed gas pump (3) with a control means (5) for activation thereof, and a means of transferring liquid (2) from the liquid reservoir (1) to a nozzle unit (12), the nozzle unit (12) comprising a means of forming a film of liquid, a means of injecting bubbles of gas into said film of liquid, said gas being forced into the nozzle unit (12) by the continuous feed gas pump (3), and a section of hardware defining an exit orifice (19) for the spray generated and wherein the nozzle unit (12) comprises a gas-liquid mixing chamber (17) fed by gas from an inner tubular passage (13) and liquid from an annular passageway (16) surrounding the inner tubular passage (13).

2. A device according to claim 1 that can be both held and activated using only one hand.

3. A device according to claim 1, wherein gas is forced directly into nozzle unit (3) upon activation.

4. A device according to claim 1, wherein the continuous feed gas pump (3) has valving means.

5. A device according to claim 4, wherein the continuous feed gas pump (3) is a peristaltic pump or scroll pump.

6. A device according to claim 5, wherein the continuous feed gas pump (3) is a scroll pump.

7. A device according to claim 1, wherein the pump (3) generates from 10 to 30 psig. (1.70 to 3.77 bar).

8. A device according to claim 1, designed to achieve a gas to liquid mass ratio upon mixing of greater than 0.06:1 and less than 1:1.

9. A device according to claim 1, comprising a means of further increasing droplet break-up.

10. A device according to claim 1, wherein the means of transferring liquid from the liquid reservoir to the nozzle unit comprises a transfer conduit comprising one or more valves.

11. A device according to claim 1, wherein a single continuous feed gas pump serves both to force gas into the nozzle unit and as a gas compressor creating an elevated pressure above the liquid in the reservoir.

12. A device according to claim 1, that uses air as the gas.

13. A method of spraying a liquid composition comprising the use of a device as described in claim 1.

14. A method according to claim 13, wherein gas is fed into the nozzle unit in advance of the liquid.

15. A method according to claim 13, wherein gas is fed through the nozzle unit subsequent to the flow of the liquid stopping.

16. A method according to claim 15 for the spraying of a liquid composition comprising dissolved or suspended solids.

17. A product comprising a device as described in claim 1 and a liquid composition for spraying therefrom.

18. A product according to claim 17, wherein the liquid composition is a cosmetic composition comprising a liquid carrier fluid.

19. A product according to claim 18, wherein the liquid carrier fluid is water and/or a C2 to c4 alcohol.

* * * * *